US007212005B2

(12) United States Patent
Bumen

(10) Patent No.: US 7,212,005 B2
(45) Date of Patent: May 1, 2007

(54) IGNITION COIL TESTER

(75) Inventor: Werner Bumen, Kirchheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/045,245

(22) Filed: Jan. 27, 2005

(65) Prior Publication Data

US 2005/0200361 A1 Sep. 15, 2005

(30) Foreign Application Priority Data

Jan. 27, 2004 (DE) ..... 10 2004 004 005
Apr. 8, 2004 (DE) ..... 10 2004 017 307

(51) Int. Cl.
*F02P 17/00* (2006.01)

(52) U.S. Cl. ..... 324/378; 324/388; 324/402

(58) Field of Classification Search ..... 324/378, 324/388, 402

See application file for complete search history.

(56) References Cited

U.S. PATENT DOCUMENTS 2,071,279 A * 2/1937 Brick ..... 324/387
2,501,802 A * 3/1950 Walker ..... 324/388
3,354,387 A * 11/1967 Whaley et al. ..... 324/547
4,090,125 A * 5/1978 Warner ..... 324/399
5,419,300 A * 5/1995 Maruyama et al. ..... 123/634
5,537,983 A * 7/1996 Nakajima ..... 123/635
5,875,767 A * 3/1999 Bock et al. ..... 123/635
6,396,277 B1 * 5/2002 Fong et al. ..... 324/402
6,426,626 B1 * 7/2002 Kravis ..... 324/388
6,703,770 B2 * 3/2004 Suzuki et al. ..... 313/141
6,836,120 B1 * 12/2004 Lite ..... 324/388
6,842,007 B2 * 1/2005 Butler et al. ..... 324/378
6,850,070 B2 * 2/2005 McQueeney et al. ..... 324/388
6,857,420 B2 * 2/2005 Weimert ..... 123/635

FOREIGN PATENT DOCUMENTS

DE 298 18 882 4/2000

* cited by examiner

*Primary Examiner*—Andrew Hirshfeld
*Assistant Examiner*—Thomas Valone
(74) *Attorney, Agent, or Firm*—Kenyon & Kenyon LLP

(57) ABSTRACT

The present invention relates to an ignition coil tester having a control module and an output electronics for testing the functioning of rod-type ignition coils, which is connectible to a diagnostic tester, the rod-type ignition coil having a primary winding and a secondary winding for generating the ignition voltage as well as a field guide plate, a plug connector and a secondary output. To be able to perform a component test on a rod-type ignition coil uninstalled from an internal combustion engine, the present invention provides for the ignition coil tester to have a housing and a spark plug dome for receiving the rod-type ignition coil, the dimensions and shape of which essentially correspond to those of a spark plug dome in an internal combustion engine and/or are adjustable to the dimensions of the latter.

5 Claims, 1 Drawing Sheet

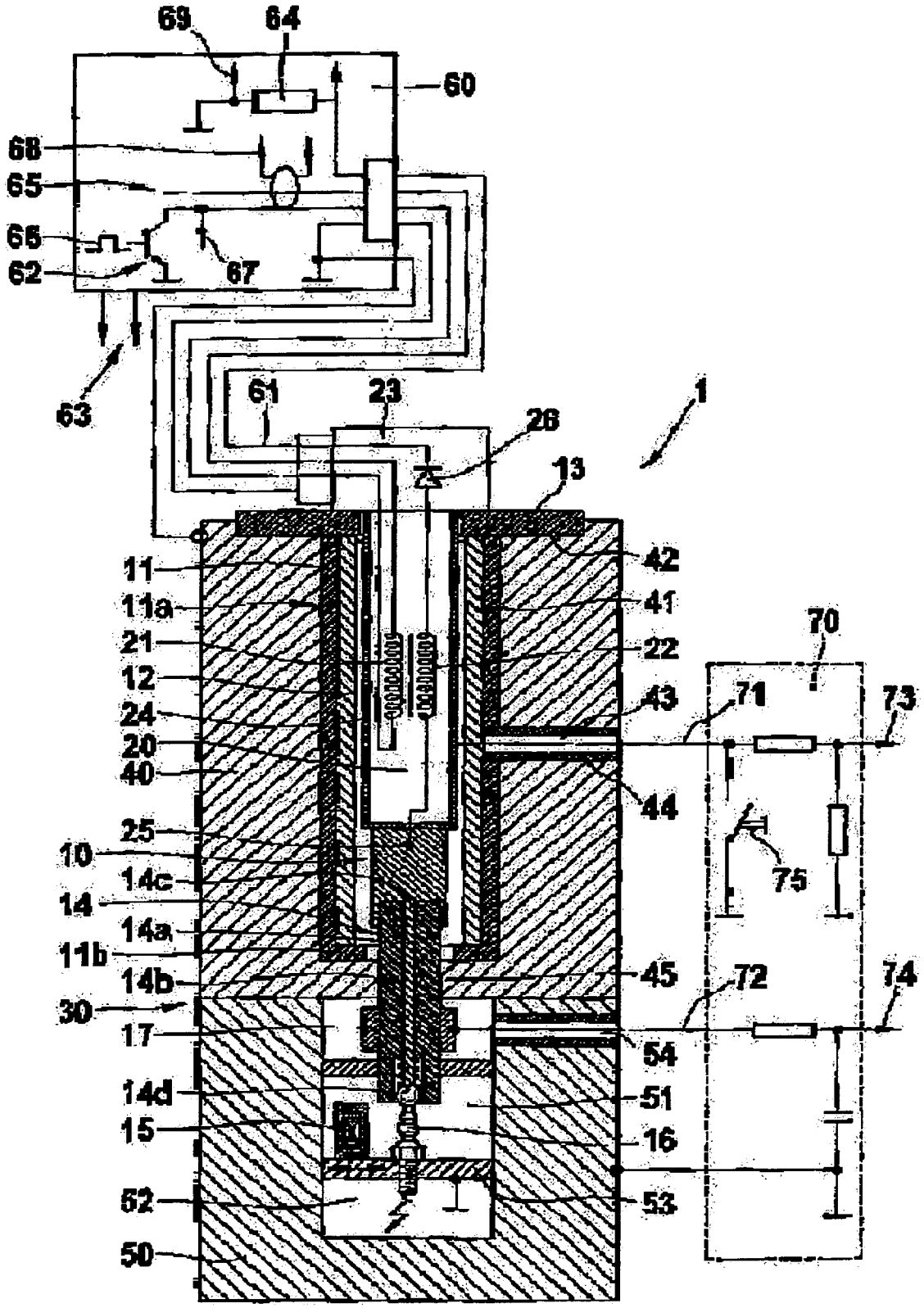
69
64
60
68
65
66
62
67
63
61
23
26
1
13
42
11
11a
41
21
22
70
12
43
71
73
24
20
40
44
25
10
14c
75
14
14a
11b
14b
45
72
74
30
17
54
14d
51
15
16
52
53
50

IGNITION COIL TESTER

FIELD OF THE INVENTION

The present invention relates to an ignition coil tester for testing the functioning of rod-type ignition coils, which is connectible to a diagnostic tester, the rod-type ignition coil having a primary winding and a secondary winding for generating the ignition voltage as well as a field guide plate, a plug connector and a secondary output.

BACKGROUND INFORMATION

To measure the high voltage transmitted from an ignition coil to the spark plug via a cable for the purpose of testing the functioning of single-spark ignition coils, a tong-test instrument is already known, which can be clamped onto the outer shell of the line carrying the high voltage. For this purpose, two conductor surfaces of the tong-test instrument surround the high-voltage cable. In this manner, the ignition coil can be tested in the installed state. Ignition devices having multiple rod-type ignition coils for an internal combustion engine are known from German Published Patent Application No. 298 18 882. In this instance, the rod-type ignition coils are located within a so-called spark plug dome of the cylinder head of the internal combustion engine.

A high-voltage connector attached to the respective rod-type ignition coil, which establishes the connection between a high-voltage output of the rod-type ignition coil and a terminal stud of the spark plug that is mounted in a stationary manner in the spark plug dome, is inserted into the spark plug dome.

In internal combustion engines having rod-type ignition coils, in which the latter are directly connected to the spark plugs without the interconnection of a cable, an ignition coil test cannot be performed in the installed state of the rod-type ignition coils by using the known tong-test instrument since the secondary winding and the secondary circuit of the rod-type ignition coils for the ignition voltage diagnosis are partly inaccessibly located inside the spark plug domes.

For this reason, rod-type ignition coils today are tested in the uninstalled state. Requiring numerous auxiliary devices, the loose measuring structures used for this purpose, however, for safety-related reasons do not allow for the measurement to be carried out directly on the internal combustion engine. Moreover, the testing conditions of an uninstalled rod-type ignition coil are different that those of one that is installed. Consequently, the testing results do not completely match the actual values in the operating state or it is not possible to perform all tests under actual conditions.

The objective of the present invention is to provide an ignition coil tester in connection with a diagnostic tester for the component testing of a rod-type ignition coil uninstalled from an internal combustion engine.

SUMMARY OF THE INVENTION

The objective of the present invention is achieved in that an ignition coil tester has a housing and a spark plug dome for receiving the rod-type ignition coil, the dimensions and shape of which essentially correspond to those of a spark plug dome in an internal combustion engine and/or are adjustable to the dimensions of the latter. The ignition coil uninstalled from the internal combustion engine is installed into the ignition coil tester, where it is tested. Adjusting the shape of the ignition coil dome of the ignition coil tester to the shape of the ignition coil dome in the internal combustion engine allows the test to be performed under nearly actual ambient conditions. The compact construction of the ignition coil tester, into which the required auxiliary devices for spark plug testing are integrated, allows for ignition coils to be tested while respecting the safety-related requirements without having loose measuring structures outside of the internal combustion engine.

In a preferred specific embodiment, the diameter of the spark plug dome is adjustable to the diameter of the rod-type ignition coil and of the spark plug dome of the internal combustion engine by way of an interchangeable insulator and/or an interchangeable metal sleeve. This variable construction allows for the ignition coil tester to be optimally adapted to the geometry of the spark plug dome of the internal combustion engine. Through coupling capacitances to the electrical ground of the metal sleeve or of the housing of the ignition coil tester, the distance between the metal sleeve and the rod-type ignition coil determines the damping ratio, which in this manner can be adjusted to the actual conditions.

If the height of the spark plug dome can be adjusted to the length of the rod-type ignition coil and of the spark plug dome of the internal combustion engine using an interchangeable or adjustable distance adjustment piece, then the ignition coil tester can be used for different rod-type ignition coils of different lengths as well as for different internal combustion engines having spark plug domes of different lengths. Due to the fact that a spark plug or a gas spark gap can be inserted into the ignition circuit, the necessary tests can be carried out at the rod-like ignition coil. Thus, the spark plug may be switched into the ignition circuit for measuring ignition voltage and for testing diodes. For diagnosing the ignition signal and for testing the ignition reserve, on the other hand, a suitable gas spark gap may be used.

The electrical connection between the rod-type ignition coil and the chosen spark gap may be established by an adjustment sleeve as a connecting piece from the secondary output of the rod-type ignition coil to the gas spark gap or the spark plug. The adjustment sleeve may be adjusted in its dimensions as well as in the design of its end contacts to the rod-type ignition coil to be tested in the respective installation configuration and to the contacts of the spark gaps, which allows for a correspondingly versatile use of the ignition coil tester.

For capacitive ignition signal uncoupling for diagnosing the ignition voltage, a capacitive sensor may be attached to the adjustment sleeve. In this region it is possible to provide sufficient space for accessing the secondary electric circuit. Furthermore, the construction of the adjustment sleeve may be optimally adjusted to the measuring task of determining the precise ignition voltage by choosing suitable dimensions and materials.

Due to the fact that the housing in the region of the capacitive sensor has an aperture for a measuring line of the capacitive sensor and/or in the region of the field guide plate has an aperture for contacting the field guide plate, the corresponding measuring signals may be transmitted via measuring and/or signal lines from the housing of the ignition coil tester to the output electronics and the diagnostic system.

The aperture for contacting the field guide plate and the metal sleeve is preferably insulated with respect to a signal line by a high-voltage insulation. This prevents the measuring signal from being diverted to the housing of the ignition coil tester when an insulation test is performed at this location regarding high-voltage flashovers in the rod-type ignition coil to the field guide plate or to the surroundings.

For reasons of a simple manufacture of the ignition coil tester, the housing may be provided as a one-part or multi-part design. Particularly a multi-part construction may avoid difficult undercutting processes.

A particularly compact and user-friendly design of the entire assemblage is achieved when the control module is connected with the housing as one unit.

The ignition coil tester may also be designed in such a way that it can be used for testing single-spark ignition coils having secondary windings situated outside of the spark plug dome. Here too it is an advantage that the single-spark ignition coil can be tested in the spark plug dome of the ignition coil tester under almost actual conditions. The ignition coil tester may thus be used in a very versatile manner.

BRIEF DESCRIPTION OF THE DRAWING

The FIGURE shows a sectional view in the longitudinal direction of an ignition coil tester with an inserted rod-type ignition coil.

DETAILED DESCRIPTION

The FIGURE shows an ignition coil tester 1 with an inserted rod-type ignition coil 20. Ignition coil tester 1 is made of a housing 30, which is made up of an upper housing part 40 and a lower housing part 50.

Upper housing part 40 surrounds a recess 41, the dimensions of which essentially correspond to the dimensions of a spark plug dome of common internal combustion engines. An interchangeable insulator 11 and within it an interchangeable metal sleeve 12 are inserted in recess 41.

Recess 41, insulator 11 and metal sleeve 12 have a cylindrical shape in the design shown. However, depending on the shape of rod-type ignition coil 20 and of the spark plug dome of the internal combustion engine to be adjusted, other geometries are possible as well.

On the side facing lower housing part 50, the cylindrically shaped region 11*a* of insulator 11 is bounded by a peripheral frontal termination 11*b*, which has metal sleeve 12 abutting against it. Metal sleeve 12 is thus completely insulated with respect to housing 30. If no insulation test is conducted, then metal sleeve 12 may be connected to ground (B−) via a switch 75.

Rod-type ignition coil 20 having primary winding 21 and secondary winding 22, field guide plate 24 and secondary output 25 is located within metal sleeve 12, which bounds spark plug dome 10 of ignition coil tester 1. Only plug connecter 23 of rod-type ignition coil 20 having built-in switch-on diode 26 and integrated output stage is located outside of spark plug dome 10.

At the upper opening of recess 41, a receptacle 42 in the form of a peripheral, stepped milled-out recess is provided for receiving an interchangeable distance adjustment piece 13. Using this distance adjustment piece 13, it is possible to adjust the height of spark plug dome 10 to the length and to the diameter of rod-type ignition coil 20. Rod-type ignition coil 20 rests with its plug connector 23 against distance adjustment piece 13.

On the opposite side, recess 41 passes over into a cylindrical duct 45 having a smaller diameter than recess 41 of upper housing part 40.

In the region of field guide plate 24 of rod-type ignition coil 20, upper housing part 40 has a radially positioned aperture 43 in the form of a bore hole, the surface of which is lined with a high-voltage insulation 44. Aperture 43 receives a signal line 71.

Lower housing part 50 is flanged to upper housing part 40 on the side of duct 45. Together with the bottom side of upper housing part 40, it forms a recess 51, which, separated by a moveable mounting plate 53, is closed off by a spark chamber 52. On or at grounded mounting plate 53 in the design shown, a gas spark gap 15 is mounted as well as, in a specifically provided tape hole, a spark plug 16, the electrodes of which project into spark chamber 52. However, additional spark gaps, for example various gas spark gaps, may also be provided.

An adjustment sleeve 14 is provided between secondary output 25 of rod-type ignition coil 20 and spark plug 16 switched into the ignition circuit as a spark gap in the example shown. This is made up of a conductive core 14*a*, which is embedded in an insulating sleeve 14*b*. Insulating sleeve 14*b* itself is fitted into duct 45 of upper housing part 40 and projects with its one side into recess 41 of upper housing part 40 and with its other side into recess 51 of lower housing part 50. On the side of upper housing part 40, an input contact 14*c* connected to conductive core 14*a* provides a conductive connection to secondary output 25 of rod-type ignition coil 20, and an output contact 14*d*, likewise connected to conductive core 14*a*, provides a conductive connection to the chosen spark gap, in the case shown to spark plug 16.

On the side of lower housing part 50, a capacitive sensor 17 is situated on the outer surface of adjustment sleeve 14 in the region of conductive core 14*a*. This is connected to a measuring line 72, which is guided to the outside via an aperture 54 radially positioned in lower housing part 50. The sensor is used for uncoupling the ignition signal for the diagnosis of the ignition voltage.

Measuring line 72 and signal line 71 are guided into a schematically represented output electronics 70, which in turn has two measuring outputs 73, 74 for connecting a diagnostic system (not shown).

Plug connector 23 of rod-type ignition coil 20 is connected to a control module 60 via an adapter line 61. Ignition coil tester 1 is supplied with voltage via a voltage input 63 on control module 60. Control module 60 has a shunt 64 for measuring the secondary ignition current (measuring point (69)) and, in the variant of the embodiment shown, an output stage 62. In the case of rod-type ignition coils 20 that have an integrated output stage, this output stage 62 may be omitted, although the fundamental construction of ignition coil tester 1 and its mode of operation remain the same. Supply voltage B+ (input (65)) of rod-type ignition coil (20) may be set in a variable manner, whereby the secondary voltage can be adjusted to the specification of the ignition coil. This makes it possible to test the ignition reserve and the voltage endurance of the insulation of rod-type ignition coil (20). Within control module (60), primary control signal (66) adjustable in terms of pulse duration, primary voltage (measuring point (67)), primary current (measuring point (68)), adjustable supply voltage (input (65)) and secondary ignition current (measuring point (69)) are available for evaluation. By disconnecting the supply voltage, the spark gaps can be safely changed.

An extension of the described ignition coil tester (1) makes it possible also to adjust parameters such as the operating temperature of the rod-type ignition coil (20) and the compression pressure in spark chamber (52) to the actual conditions existing in the internal combustion engine. It is then possible to test rod-type ignition coils (20) under the same conditions as in the internal combustion engine.

What is claimed is:

1. An ignition coil tester, comprising:

a control module;

an output electronics for testing the functioning of an ignition coil, the output electronics being connectible to a diagnostic tester, the ignition coil including a primary winding and a secondary winding for generating an ignition voltage, a field guide plate, a plug connector, and a secondary output;

a housing and first spark plug dome for receiving the ignition coil;

an interchangeable insulator; and an interchangeable adjustment metal sleeve serving as a connecting piece from the secondary output to one of a gas spark gap and a spark plug, by which a diameter of the first spark plug dome is adjustable to a diameter of the ignition coil and of the second spark plug dome in an internal combustion engine;

a capacitive sensor attached to the adjustment sleeve for uncoupling an ignition signal wherein the housing has at least one of a first aperture in a region of the capacitive sensor for a measuring line of the capacitive sensor and a second aperture in a region of the field guide plate for a signal line of the field guide plate;

wherein at least one of the first and the second apertures is electrically insulated by a high-voltage insulation and one of a spark plug and a gas spark gap can be switched into an ignition circuit.

2. The ignition coil tester of claim 1, wherein the housing has a one-part or multi-part design.

3. The ignition coil tester of claim 1, wherein the control module is connected with the housing as a unit.

4. The ignition coil tester of claim 1, wherein the first spark plug dome is separate from any internal combustion engine.

5. The ignition coil tester of claim 1, wherein the ignition coil tester is arranged for testing the functioning of the ignition coil where the ignition coil is an uninstalled state and removed from any internal combustion engine.

* * * * *